US006568725B2

(12) United States Patent
Furlong et al.

(10) Patent No.: US 6,568,725 B2
(45) Date of Patent: May 27, 2003

(54) LOCK CHASSIS

(75) Inventors: Jonathan W. Furlong, Colorado Springs, CO (US); Frederick M. Hensley, Colorado Springs, CO (US); Helmut R. Aigner, Colorado Springs, CO (US)

(73) Assignee: Schlage Lock Company, Colorado Springs, CO (US)

( * ) Notice: Subject to any disclaimer, the term of this patent is extended or adjusted under 35 U.S.C. 154(b) by 0 days.

(21) Appl. No.: 09/778,572

(22) Filed: Feb. 7, 2001

(65) Prior Publication Data

US 2002/0105196 A1 Aug. 8, 2002

(51) Int. Cl.[7] ..... E05B 3/08; E05B 3/10

(52) U.S. Cl. ..... 292/336.5; 292/336.3; 292/359; 292/165; 292/169.17; 292/337; 292/DIG. 64; 292/DIG. 53

(58) Field of Search ..... 292/336.5, 336.3, 292/357, 359, 245, 165, 167, 169.17, 169.15, 337, DIG. 64, DIG. 52, DIG. 53, 244; 403/383, 353

(56) References Cited

U.S. PATENT DOCUMENTS 618,486 A 1/1899 Stanley
3,655,230 A * 4/1972 Armstrong ..... 292/169
4,272,974 A 6/1981 Hennessy
4,594,864 A * 6/1986 Hart ..... 292/1.5
4,854,620 A 8/1989 Dunphy et al.
5,335,525 A 8/1994 Solovieff
5,732,578 A * 3/1998 Kang ..... 292/336.3
5,769,472 A * 6/1998 Small ..... 292/1.5
5,983,687 A * 11/1999 Shen ..... 292/169.22
6,038,894 A * 3/2000 Hu ..... 292/336.5
6,279,360 B1 * 8/2002 Shen ..... 292/336.3

* cited by examiner

*Primary Examiner*—J. J. Swann
*Assistant Examiner*—Matthew E. Rodgers
(74) *Attorney, Agent, or Firm*—Michael Best & Friedrich LLP

(57) ABSTRACT

A lock chassis including a chassis housing having two substantially identical housing halves. The housing halves mate to form the housing when oriented 180° relative to each other. The housing halves include sidewalls having a lateral face positioned to abut the opposite housing half when the housing halves are coupled together. The housing is secured by lugs that mate with pockets in the lateral face of the sidewall of the opposite housing half and screws which extend through apertures in one housing half and into threaded holes in the lateral face of the sidewall of the opposite housing half.

19 Claims, 4 Drawing Sheets

LOCK CHASSIS

BACKGROUND AND SUMMARY OF THE INVENTION

The present invention relates to a lock chassis for securing a door and particularly to a lock chassis designed to move a latchbolt between an extended and a retracted position. More particularly, the present invention relates to a lock chassis wherein rotational motion of a spindle translates into linear motion of a slide, which retracts the latchbolt.

Conventional door latch mechanisms include a lock chassis which moves a latchbolt between an extended position and a retracted position. In the extended position, the latchbolt engages a hole in the doorframe and the door cannot freely open. With the latchbolt retracted, the door can be freely opened.

A typical lock chassis includes a spindle that interacts with a slide. The slide is typically slidably positioned between a chassis frame and a chassis flange coupled to the chassis frame. Further, a typical lock chassis includes a cover, which surrounds and contains the frame, the slide, and the flange. Rotation of the spindle translates into linear motion of the slide through a camming action. The slide engages the latchbolt and "pulls" the latchbolt out of its extended position and into its retracted position. The spindle of a typical lock chassis is coupled to a door handle or lever and is rotated when a user turns the door handle. Thus, turning the door handle draws the latchbolt out of its extended position and into its retracted position, allowing the door to be opened.

As described above, the typical lock chassis includes several parts, which necessitate several steps for assembly. Also, given the structure described above, a lateral blow to the door handle is translated through the lock chassis via the spindle. Because of this, such a blow to the door handle can cause the chassis frame to separate from both the chassis flange and the cover inside the door. In this way, access to the lock chassis can be gained from the outside of the door and the latchbolt can be retracted, thus allowing the door to be opened by an unauthorized user.

For a door latching mechanism to achieve a particular rating, industry regulations dictate that the lock chassis withstand certain lateral forces applied to the door handle. Therefore, a lock chassis which is easily assembled and which withstands certain lateral and axial forces would be welcomed by users of such a lock chassis.

According to the present invention, a lock chassis includes a chassis housing having two substantially identical housing halves. The housing halves are formed so they mate to form the housing when oriented 180° relative to each other.

In preferred embodiments, the housing halves are formed to include sidewalls, which include a lateral face positioned to abut the opposite housing half when the housing halves are coupled together. The housing is secured by lugs that mate with pockets in the lateral face of the sidewall of the opposite housing half and screws which extend through apertures in one housing half and into threaded holes in the lateral face of the sidewall of the opposite housing half.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
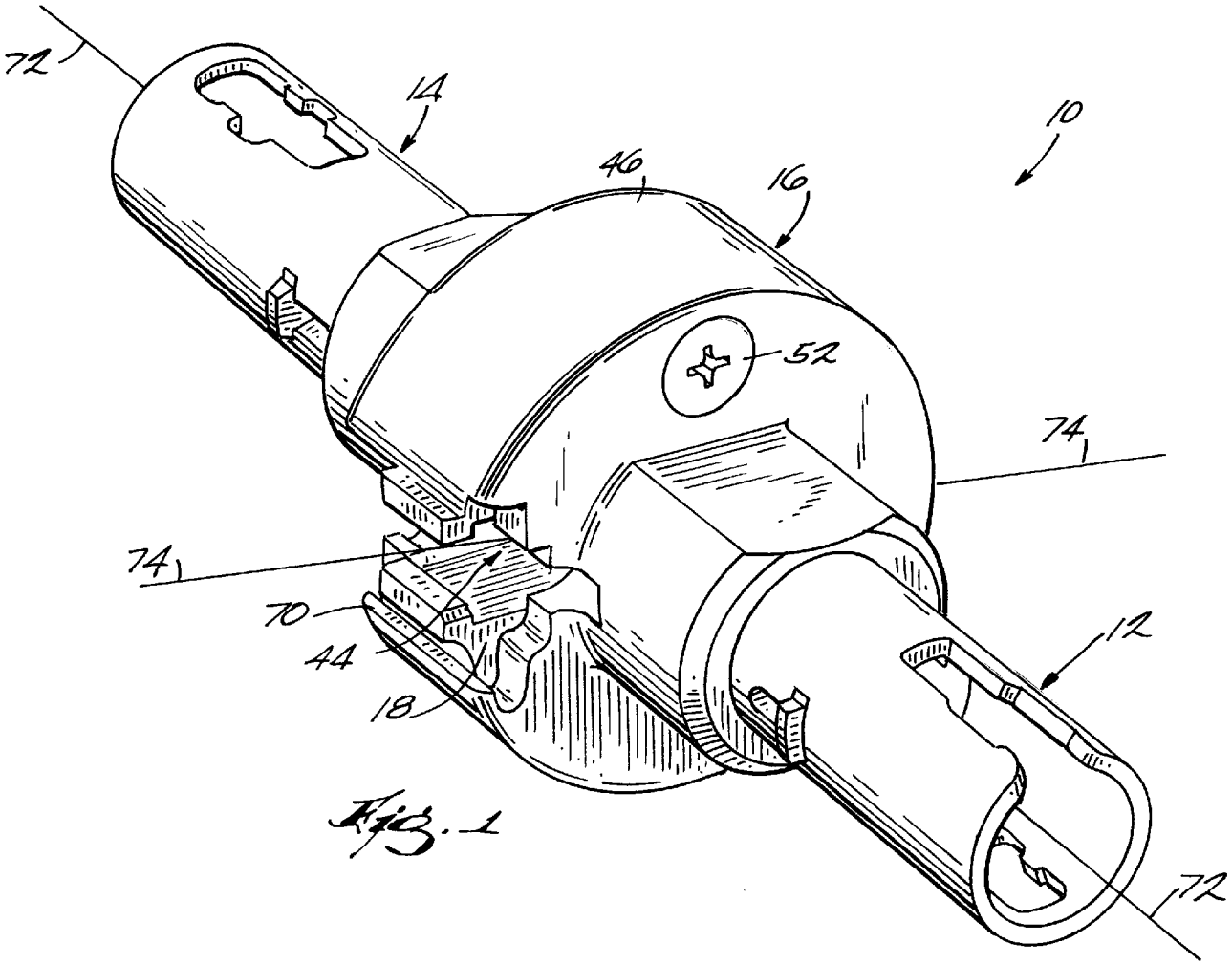
FIG. 1 is a perspective view of a lock chassis in accordance with the present invention, including a chassis housing, two spindles, and a slide contained within the housing.
Figure 2:
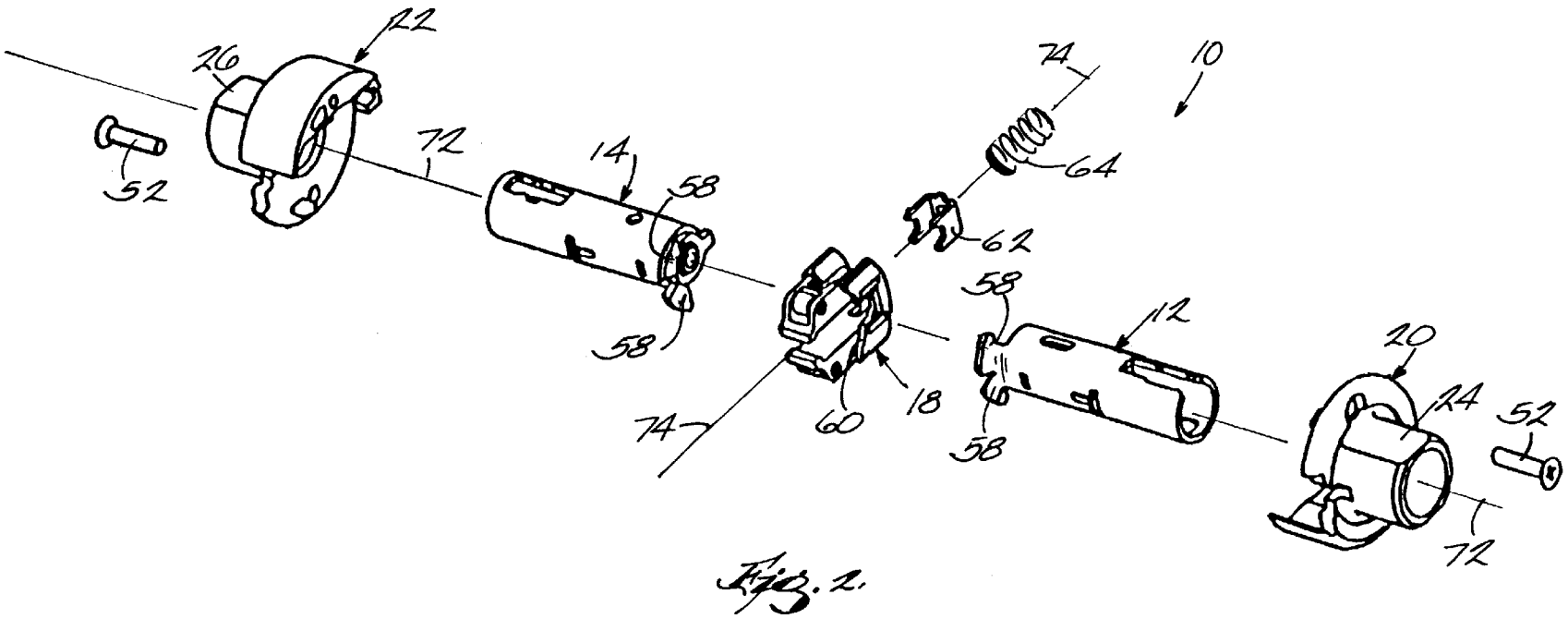
FIG. 2 is a disassembled view of the lock chassis of FIG. 1, including a first and a second housing half, the first and second spindles, and the slide.
Figure 3:
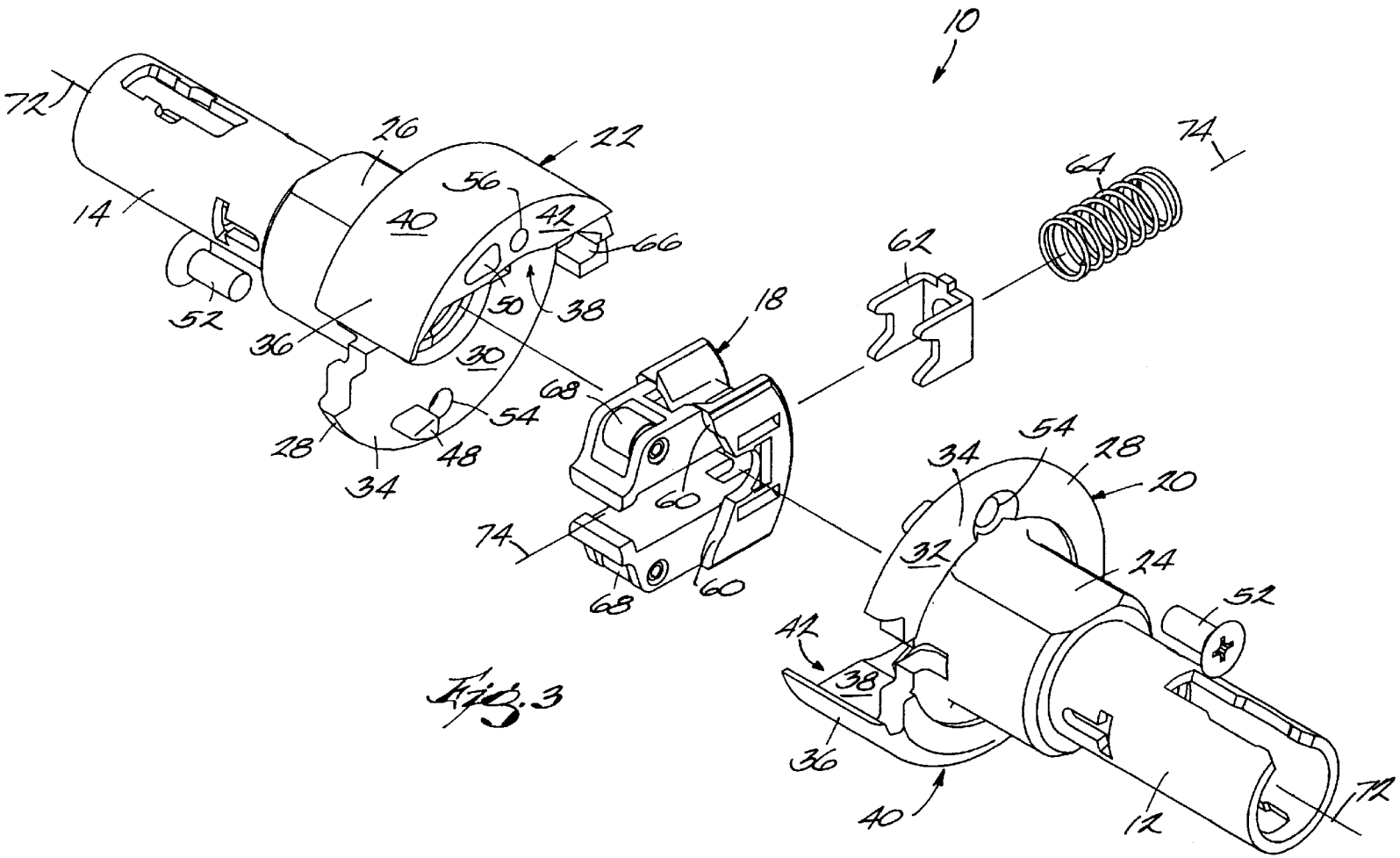
FIG. 3 illustrates another disassembled view of the lock chassis of FIG. 1, with the first and second spindles inserted through a first hub and a second hub formed as part of the first and second housing halves.

Referring to FIG. 1, a lock chassis 10, according to a preferred embodiment of the present invention, includes a first spindle 12, a second spindle 14, a housing 16, and a slide 18. As seen in FIGS. 2 and 3, the housing 16 comprises a first housing half 20 and a second housing half 22. The first housing half 20 and the second housing half 22 are formed to include a first and a second hub 24, 26, respectively. As shown in FIG. 3, the first and second spindles 12, 14 are positioned within and extend through the first and second hubs 24, 26, respectively. The hubs 24, 26 provide bearing surfaces for the first and second spindles 12, 14, allowing the spindles 12, 14 to rotate within the hubs 24, 26.

Figure 4A:
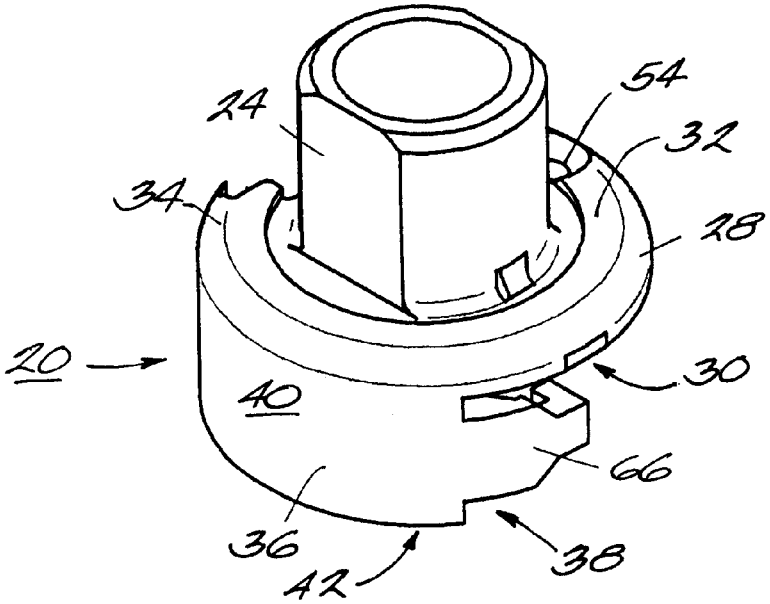
FIG. 4A illustrates a perspective view of the first housing half of FIG. 3.
Figure 4B:
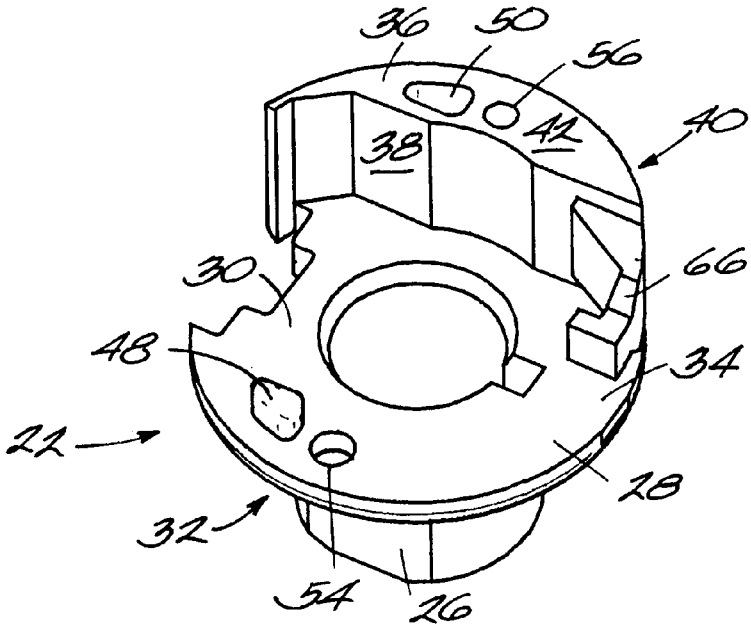
FIG. 4B illustrates a perspective view of the second housing half of FIG. 3 taken opposite the perspective view of FIG. 4A.

According to a preferred embodiment of the present invention, the first and second housing halves 20, 22 are identical and are shown in FIGS. 4A and 4B. Each of the housing halves 20, 22 includes a circular base 28 having a first side 30, a second side 32, and a circumference 34. Additionally, each housing half 20, 22 includes a sidewall 36 having an inner surface 38, an outer surface 40, and a lateral face 42.

As will be readily apparent to one of ordinary skill in the art, with the housing halves 20, 22 coupled together to form the housing 16, as shown in FIG. 1, a chamber 44 is created between the two housing halves 20, 22. The chamber 44 is defined by the first sides 30 of the circular bases 28 and the inner surfaces 38 of the sidewalls 36. The slide 18 is positioned to lie within the chamber 44 and slides between an extended position towards a latchbolt opening 70 (FIG. 1) and a retracted position away from latchbolt opening 70 and towards a pair of spring seat arms 66 (FIGS. 3, 4A, and 4B) formed as part of housing halves 20, 22.

As will also be readily understood by one of ordinary skill in the art with reference to FIG. 2, rotational motion of either the first or second spindle 12, 14 around a first axis or chassis axis 72 causes the slide 18 to move between its extended and retracted positions along a second axis or slide axis 74 perpendicular to the first axis 72. As will be readily apparent to one of ordinary skill in the art, rotational motion of either the first or second spindle 12, 14 is translated into linear motion of the slide 18 through cams 58, formed as part of the first and second spindles 12, 14, acting on cam surfaces 60 (best seen in FIG. 3), formed as part of the slide 18. The cams 58 are shown formed integrally with the first and second spindles 12, 14, but may also be formed separately and coupled to the spindles 12, 14.

The sliding motion of the slide 18 within the chamber 44 is further facilitated by a spring 64 and a slide catch 62, which act between the slide 18 and the spring seat arms 66 to bias the slide 18 towards the latchbolt opening 70. When the housing halves 20, 22 are coupled together, the spring seat arms 66, formed as part of the housing halves 20, 22, cooperate to provide a seat for the spring 64. The sliding motion of the slide 18 within the chamber 44 is also aided by rollers 68 rotatably coupled to the slide 18. The rollers 68 roll against the inner surfaces 38 of the sidewalls 36 as the slide 18 moves between its extended and retracted positions.

As best seen with reference to FIGS. 3, 4A, and 4B, according to a preferred embodiment of the present invention, housing halves 20 and 22 are identical and, when oriented 180 degrees relative to each other around the second axis 74, are coupled to form housing 16, as shown in FIG. 1. Each housing half 20, 22 includes a lug 48 projecting from the first side 30 of the circular base 28. When housing halves 20, 22 come together, the lug 48 mates with a pocket 50 formed into the lateral face 42 of the sidewall 36 of the opposite housing half 20 or 22. In this way, the lateral face 42 of the sidewall 36 of the second housing half 22 abuts and lies adjacent to the first side 30 of the circular base 28 of the first housing half 20. Similarly, the lateral face 42 of the sidewall 36 of the first housing half 20 abuts and lies adjacent to the first side 30 of the circular base 28 of the second housing half 22. The housing 16 is further secured by screws 52 which fit through apertures 54 in the circular bases 28 of each housing half 20, 22 and are then threaded into threaded holes 56 in the lateral faces 42 of the opposite housing half 20, 22, as shown in FIG. 3. However, it will be readily understood by one of ordinary skill in the art that the housing halves 20, 22 may be staked, welded, or pinned, etc., rather than screwed.

With the housing 16 assembled as described, the outer surfaces 40 of the sidewalls 36 of both housing halves 20, 22 cooperate to define an exterior surface 46 (FIG. 1) of the overall housing 16. When the lock chassis 10 is installed in a door (not shown), the housing 16 is positioned snuggly into a bore (also not shown) cut into the door to receive the lock chassis 10. Thus installed, the exterior surface 46 of the housing 16 lies in close proximity to an interior surface of the bore formed to receive the lock chassis 10. In the event a lateral force is applied to a handle or lever (not shown) coupled to the lock chassis 10, the force will be translated to the housing 16 via first or second spindle 12, 14. The housing 16 will dissipate the force and distribute it over the exterior surface 46. The force will then be translated to at least a portion of the interior surface of the bore cut into the door to house the lock chassis 10. The force is translated to the bore because the bore's interior surface lies in close proximity to the exterior surface 46 of the housing 16. The force is then further dissipated through the door itself.

Although the invention has been described in detail with reference to certain preferred embodiments, variations and modifications exist within the scope and spirit of the invention as described and defined in the following claims.

What is claimed is:

1. A door lock chassis, comprising:

a slide having a cam surface;

a spindle defining a chassis axis and having a cain, the cam being adapted to engage the cam surface and translate rotational motion of the spindle around the chassis axis into linear motion of the slide along a slide axis, which is substantially perpendicular to the chassis axis;

a housing comprising two substantially identical housing halves, which, when oriented relative to each other approximately 1800 around the slide axis, mate with each other to form the housing, the housing being formed to define a chamber adapted to facilitate sliding motion of the slide within the chamber and relative to the housing; and wherein each housing half comprises a substantially circular base, the base having a first side, a second side, and a circumference, and each housing half further includes a sidewall projecting from the first side of the base of the housing half and positioned along a portion of the circumference, each sidewall having an outer surface that comprises an outer surface of the housing and is positioned to lie adjacent to an inner surThce of a bore in a door into which the door lock chassis is installed.

2. The door lock chassis of claim 1, wherein the portion of the circumference of the base along which the sidewall is positioned constitutes less than one half the entire circumference of the base.

3. The door lock chassis of claim 1, wherein each housing half is formed to include a hub, which projects from the second side of the base of the housing half.

4. The door lock chassis of claim 1, wherein the sidewall of each housing half includes an outer surface, the outer surfaces of the sidewalls of the housing halves cooperate to form an exterior surface of the housing, and the exterior surface of the housing lies in close proximity to an interior surface of a bore hole cut in a door and into which the housing is positioned.

5. The door lock chassis of claim 1, wherein the base of each housing half includes an aperture and a screw extends through the aperture and into the sidewall of the other housing half to couple to the housing halves together.

6. The door lock chassis of claim 5, wherein the sidewall of one housing half contacts the substantially circular base of the other housing half when the housing halves are coupled together to form the housing.

7. The door lock chassis of claim 1, wherein each sidewall includes a pocket which mates with a lug extending from the first side of the base of the other housing half when the housing halves are coupled together to form the housing.

8. The door lock chassis of claim 7, further comprising a spring seat arm coupled to and extending from one of the sidewall or the base, the spring seat arm engaging a spring, which communicates with the slide to facilitate movement of the slide relative to the housing.

9. The door lock chassis of claim 1, wherein, with the housing halves coupled together, the sidewalls cooperate to form a latchbolt opening.

10. A door lock chassis, comprising:

a chassis housing comprising two substantially identical housing halves, which, when oriented relative to each other approximately 180° around a first axis, mate with each other to form the housing, each housing half being formed to include a base having first and second sides and a circumference, and a sidewall extending from the first side of the base and extending along a portion of the circumference, the sidewall having an inner surface, an outer surface, and a lateral face bridging between the inner and outer surfaces, the outer surface comprising an outer surface of the chassis housing and being positioned to lie adjacent to an inner surface of a bore in a door into which the door lock chassis is installed, the lateral face of the sidewall of each housing half being positioned to lie adjacent to the first side of the base of the other housing half when the two housing halves are coupled together.

11. The door lock chassis of claim 10, further including a hub formed as part of each housing half and extending from the second side of the base, and a spindle rotatably coupled to each housing half and extending through the hub, the spindle being rotatable around a second axis, which is substantially perpendicular to the first axis.

12. The door lock chassis of claim 11, further including a chamber defined between the inner surfaces of the sidewalls of the housing halves, the chamber adapted to slidingly receive a slide, the slide being slidable in a direction substantially parallel to the first axis.

13. The door lock chassis of claim 10, wherein the base of each housing half includes a lug extending from the first side of the base and the sidewall of each housing half includes a pocket inset from the lateral face of the sidewall, and wherein the lug of each housing half mates with the pocket of the other housing half when the housing halves are oriented relative to each other approximately 180° around the first axis.

14. The door lock chassis of claim 13, wherein the base of each housing half is screwed to the lateral face of the sidewall of the other housing half to couple the housing halves together.

15. The door lock chassis of claim 10, wherein the portion of the circumference of the base along which the sidewall extends constitutes less than one half the entire circumference of the base.

16. The door lock chassis of claim 15, further comprising a slide slidably positioned within a chamber defined between the inner surfaces of the sidewalls and a spring seat arm coupled to and extending from one of the sidewall or the base, the spring seat arm engaging a spring, which communicates with the slide to facilitate movement of the slide relative to the housing.

17. A door lock chassis, comprising:

a housing comprising two substantially identical housing halves, which, when oriented relative to each other approximately 180° around a first axis and coupled together, mate with each other to form the housing, each housing half being formed to include a base having first and second sides, and a sidewall extending from the first side of the base, the sidewall having an inner surface, an outer surface, and a lateral face bridging between the inner and outer surfaces, the first side of the base of one housing half being screwed to the lateral face of the sidewall of the other housing half to couple the housing halves together.

18. The door lock chassis of claim 17, wherein the first side of the base of each housing half includes a lug, the lateral face of the sidewall of each housing half includes a pocket, and the lug of one housing half mates with the pocket of the other housing half when the housing halves are coupled together.

19. The door lock chassis of claim 18, wherein the outer surfaces of the sidewalls of the housing halves cooperate to form an exterior surface of the housing, and the exterior surface of the housing lies in close proximity to an interior surface of a bore hole cut in a door and into which the housing is positioned.

* * * * *

UNITED STATES PATENT AND TRADEMARK OFFICE

CERTIFICATE OF CORRECTION

PATENT NO. : 6,568,725 B2 
DATED : May 27, 2003
INVENTOR(S) : Jonathan W. Furlong, Fredrick M. Hensley and Helmut R. Aigner It is certified that error appears in the above-identified patent and that said Letters Patent is hereby corrected as shown below:

Column 4,
Line 3, delete "1800", insert -- 180º --.
Line 15, delete "surThce", insert -- surface --.

Signed and Sealed this

Twenty-third Day of December, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,568,725 B2 
DATED : May 27, 2003
INVENTOR(S) : Jonathan W. Furlong, Frederick M. Hensley and Helmut R. Aigner It is certified that error appears in the above-identified patent and that said Letters Patent is hereby corrected as shown below:

Column 3,
Line 62, delete “cain”, and insert -- cam --.

Signed and Sealed this

Seventeenth Day of August, 2004

JON W. DUDAS
*Acting Director of the United States Patent and Trademark Office*